US009412296B2

(12) United States Patent
Mirski-Fitton et al.

(10) Patent No.: US 9,412,296 B2
(45) Date of Patent: Aug. 9, 2016

(54) DISPLAY BRIGHTNESS ADJUSTMENT

(71) Applicant: International Business Machines Corporation, Armonk, NY (US)

(72) Inventors: Alexander D. S. Mirski-Fitton, Hursley Park (GB); Edwin P. J. Moffatt, Hursley Park (GB); Richard W. Pilot, Hursley Park (GB)

(73) Assignee: International Business Machines Corporation, Armonk, NY (US)

( * ) Notice: Subject to any disclaimer, the term of this patent is extended or adjusted under 35 U.S.C. 154(b) by 157 days.

(21) Appl. No.: 13/905,765

(22) Filed: May 30, 2013

(65) Prior Publication Data

US 2013/0321369 A1 Dec. 5, 2013

(30) Foreign Application Priority Data

May 31, 2012 (GB) ..... 1209649.1

(51) Int. Cl.
*G09G 3/32* (2016.01)

(52) U.S. Cl.
CPC ..... *G09G 3/3208* (2013.01); *G09G 3/3225* (2013.01); *G09G 2320/0233* (2013.01); *G09G 2320/0285* (2013.01); *G09G 2360/144* (2013.01)

(58) Field of Classification Search
CPC ..... G09G 3/32; G09G 3/3208; G09G 5/02
See application file for complete search history.

(56) References Cited

U.S. PATENT DOCUMENTS 6,952,195 B2 10/2005 Arakawa
7,050,114 B2 5/2006 Stessen et al.
8,040,341 B2 * 10/2011 Lin ..... 345/212
2003/0103141 A1 * 6/2003 Bechtel ..... G07C 5/0891 348/148
2004/0200953 A1 * 10/2004 Cok ..... 250/214 R
2005/0212824 A1 9/2005 Marcinkiewicz et al.
2007/0002083 A1 * 1/2007 Belmon ..... G09G 3/2003 345/694
2007/0296685 A1 12/2007 Kang et al.
2008/0191979 A1 8/2008 Nakane et al.
2009/0174658 A1 7/2009 Blatchley et al.
2009/0273843 A1 * 11/2009 Raskar et al. ..... 359/601
2010/0201275 A1 8/2010 Cok et al.
2011/0032266 A1 * 2/2011 Harbach et al. ..... 345/589
2011/0156597 A1 6/2011 Lai
2011/0227952 A1 9/2011 Hamaguchi
2011/0310114 A1 12/2011 Choi et al.

FOREIGN PATENT DOCUMENTS

EP 2293273 9/2011
JP 2009168960 7/2009

OTHER PUBLICATIONS

Balasubramanian et al., "A Novel Fuzzy Logic Based Controller to Adjust the Brightness of the Television Screen with Respect to Surrounding Light", World Academy of Science, Engineering and Technology, 2008, 4 pages.
"Apple Moves OS X 3D Closer with Unique Ambient Light Feature", Patently Apple, Apr. 29, 2010, 5 pages.

* cited by examiner

*Primary Examiner* — Amr Awad
*Assistant Examiner* — Wing Chow
(74) *Attorney, Agent, or Firm* — Yee & Associates, P.C.; Parashos Kalaitzis

(57) ABSTRACT

A display comprising an array of pixels having individually adjustable brightness levels; an array of light sensors fixed relative to the pixel array; and a brightness controller for estimating a glare footprint on the pixel array from light level data provided by the sensor array and for adjusting the relative brightness levels of pixels that fall in the estimated glare footprint.

21 Claims, 17 Drawing Sheets

DISPLAY BRIGHTNESS ADJUSTMENT

FIELD OF THE INVENTION

This invention relates to a method and apparatus for display brightness adjustment.

BACKGROUND

The invention operates in the general environment of display brightness adjustment. When a shaft of light is cast across a screen, it can cause reduced viewing quality in an area whilst leaving other parts of the display unaffected. When viewing quality is important, a user will attempt to block out a light source casting glare or unwanted shafts of light onto screen. Normally darkening the environment works but this is not always possible.

The effects of bright light on a screen can be attenuated by raising the brightness. Most devices with screens (for example, a television or a monitor) only allow the whole screen to be brightened or dimmed; adjusting to optimize affected areas can lead to the unaffected areas looking worse.

A known solution automatically adjusts brightness by light-sensors built into a device. Mobile phones often make use of this, detecting the lighting levels of their surroundings and dimming or brightening the screen accordingly. The drawback of this method is that the sensor only detects overall ambient light level, and as such the whole screen is adjusted in accordance with the measured ambient light level. This solution also suffers the same drawback as manual brightness adjustment in that brightness is adjusted for the whole screen.

BRIEF SUMMARY OF THE INVENTION

In a first aspect of the invention there is provided a display comprising: an array of pixels having individually adjustable brightness levels; an array of light sensors fixed relative to the pixel array; and a brightness controller for estimating a glare footprint on the pixel array from light level data provided by the sensor array and for adjusting the relative brightness levels of pixels that fall in the estimated glare footprint. Although the embodiments are described in terms of brightness of an individual pixel it will be understood that other properties of the pixel illumination can be controlled in a similar manner. Such properties include: the relative brightness or contrast of pixels; the brightness of individual tones; and the saturation levels of colors.

Preferably the array of light sensors extends around the display. In the preferred embodiment a bezel surrounding the screen is ringed with a circuit of light sensors. The denser the placement of these sensors, the better the results will be, but also the higher the cost so an optimum balance must be considered. When a shaft of light is cast across the screen, points on the bezel are detected where one light sensor has a higher reading than one of its neighbors. In the preferred embodiment the footprint of the shaft of light that is being cast across the screen is assumed to be a linear path between these points. The footprint is used to adjust the screen for optimal viewing: pixels in light areas can have their relative brightness raised (as pixels in the dark areas may equally have their brightness lowered). As such, the display quality across the whole screen is normalized.

More preferably the array of light sensors is a single circuit of light sensors one sensor thick. Other embodiments comprise: two circuits of light sensors; three circuits of light sensors; or more than three circuits of light sensors. The bezel surrounding the screen contains the light sensors circuit. The denser the placement of these sensors, the better the results will be, but the higher the cost so a balance must be considered. The preferred embodiment has only one sensor circuit for an effective low cost solution. Another embodiment uses two concentric circuits of sensors to eliminate some footprint errors. Another embodiment uses three concentric circuits of sensors so that curved footprints can be estimated.

Most preferably the display comprises a method of estimating a footprint that traverses the sensors to identify locations where light level changes by a threshold amount and fits a footprint shape with three or more edges bounded by edges of the pixel array and at least one line connecting two identified locations in the senor array. When a shaft of light is cast across the screen, points on the array are identified where one light sensor has a significantly higher reading than a neighbor. The preferred embodiment assumes linear paths between these points and a footprint shape of the shaft of light that is being cast across the screen is estimated.

Advantageously the threshold of light level change depends on the difference between the maximum and minimum light levels detected by the sensors. Optionally the threshold of light level change is user configurable.

More advantageously the increase in brightness level of a pixel is based on an estimated amount of light falling at the pixel location.

Most advantageously the increase in brightness levels of a pixel is user adjustable.

Suitably the display having pixels with individually adjustable brightness levels is an active matrix organic light emitting diode (AMOLED) display whereby pixels in the 'light' areas can have their brightness and contrast raised and/or pixels in the 'dark' areas can have theirs lowered. As such, the display quality across the whole screen can be normalized. AMOLED displays exist that are capable of per-pixel brightness adjustment because each pixel is a separate light source.

Most suitably the amount of light falling is estimated as uniform over a single footprint and may be different for two or more footprints over the array and may be higher for overlapping footprint areas. In the preferred embodiment, the algorithm detects footprint edges, that is transitions from light to dark or vice versa.

More suitably the amount of light falling is estimated as variable over a single footprint. In another embodiment it is possible to consider the data from the sensors in between edges. A gradient can be estimated along the edges from where the light is brightest to where it is dimmest. Other edges in the footprint can be considered and all edges interpolated to form a surface of graduated light levels within the footprint.

In a second aspect of the invention there is provided a brightness controller for a display comprising: an array of pixels having individually adjustable brightness levels and an array of light sensors fixed relative to the pixel array, said brightness controller is for estimating a glare footprint on the pixel array from light level data provided by the sensor array and for adjusting the relative brightness levels of pixels that fall in the estimated glare footprint.

In a third aspect of the invention there is provided a method for adjusting brightness levels in a display, said display comprising an array of pixels having individually adjustable brightness levels and an array of light sensors fixed relative to the pixel array, said method comprising: estimating a glare footprint on the pixel array from light level data provided by the sensor array and adjusting the relative brightness levels of pixels that fall in the estimated glare footprint.

In a fourth aspect of the invention there is provided a computer program product for controlling brightness of a display, said computer program product comprising computer readable recording medium having computer readable code stored thereon for performing the method of any one of claims 11 to 18.

In a fifth aspect of the invention there is provided a computer program stored on a computer readable medium and loadable into the internal memory of a digital computer, comprising software code portions, when said program is run on a computer, for performing the method of any of claims 11 to 18.

BRIEF DESCRIPTION OF THE DRAWINGS

Preferred embodiments of the present invention will now be described, by way of example only, with reference to the following drawings in which.

DETAILED DESCRIPTION OF THE EMBODIMENTS

Figure 1:
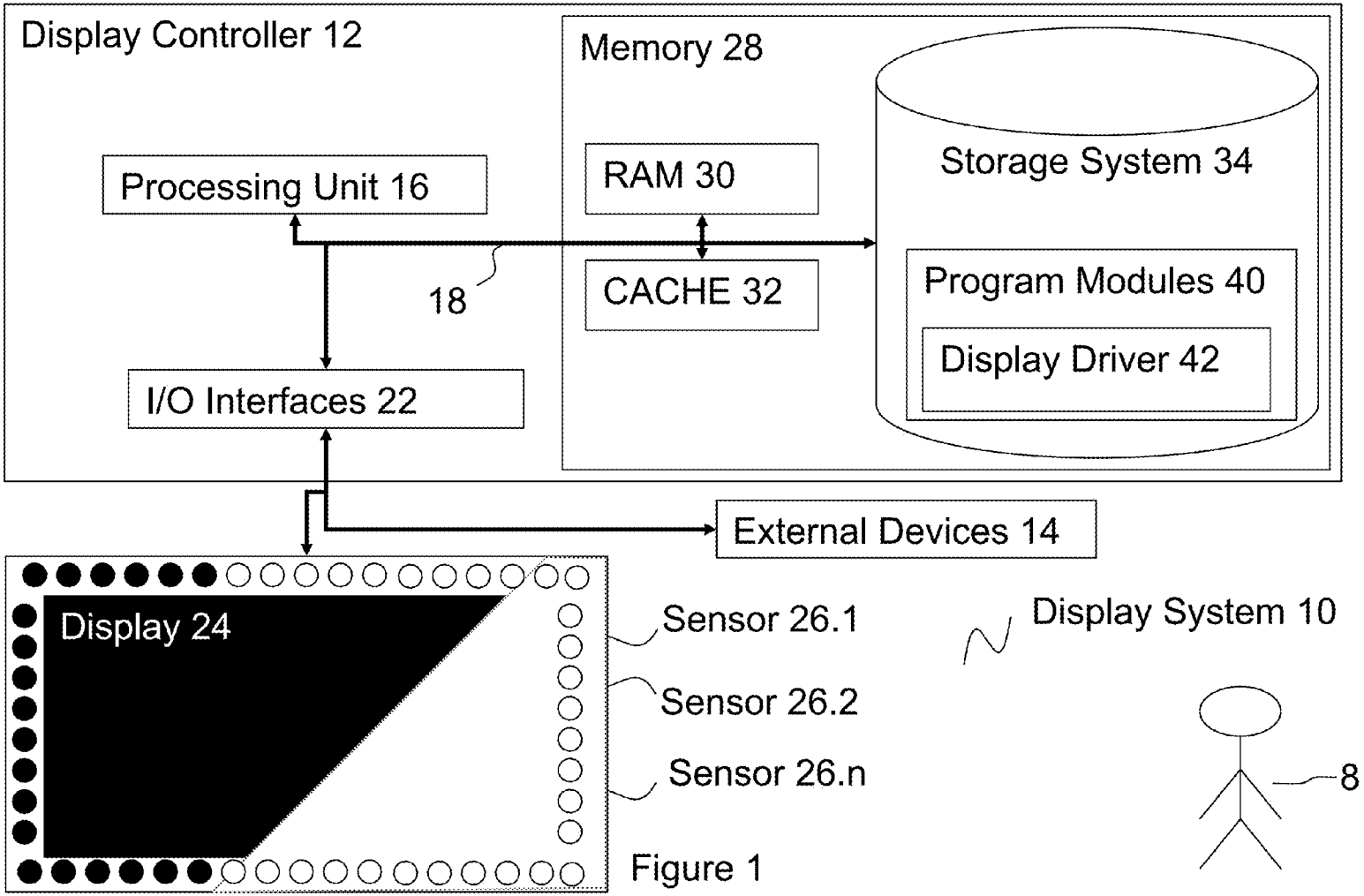
FIG. 1 is a deployment diagram of the system of the preferred embodiment.

Referring to FIG. 1, there is shown a component diagram of a display system 10 according to the embodiments. Display system 10 is operational with numerous other general purpose or special purpose computing system environments or configurations. Examples of well-known computing processing systems, environments, and/or configurations that may be suitable for use with display system 10 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices or equivalents.

Display system 10 may be described in the general context of computer system-executable instructions, such as program modules, being executed by a computer system. Generally, program modules may include routines, programs, objects, components, logic, data structures, and so on that perform particular tasks or implement particular abstract data types. As shown in FIG. 1, display system 10 is shown in the form of a display controller 12 connected to display 24 and external devices 14. The components of display controller 12 may include, but are not limited to, one or more processors or processing units 16, a memory 28, and a bus 18 that couples various system components including memory 28 to processor 16.

Display 24 is a display having individual pixel brightness control. Along the outside of the display is a first bezel comprising a rectangular circuit of sensors (26.1, 26.2, . . . 26.n)

Sensors (26.1, 26.2, . . . 26.n) are for measuring glare falling upon the display and comprise fast light detecting diodes in the preferred embodiment. In other embodiments, any light detecting device such as light detecting resistors or light detecting transistors can be used.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus. Display system 10 typically includes a variety of computer system readable media. Such media may be any available media that is accessible by display system 10, and it includes both volatile and non-volatile media, removable and non-removable media Memory 28 includes computer system readable media in the form of volatile memory, such as random access memory (RAM) 30 and cache memory 32, and in the form of non-volatile or persistent storage 34. Display controller 12 may further include other removable/non-removable, volatile/non-volatile computer system storage media. By way of example only, storage 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (for example, at least one) of program modules that are configured to carry out the functions of embodiments of the invention.

Display controller 12 may also communicate with one or more external devices 14 such as a keyboard or a pointing device that enables a user 8 to interact with the display controller 12. Such communication can occur via I/O interfaces 22.

A set of program modules 40, including display driver 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment.

Display driver 42 is a program module 40 that is provided for carrying out the functions and/or methodologies of embodiments of the invention as described herein.

Figure 2:
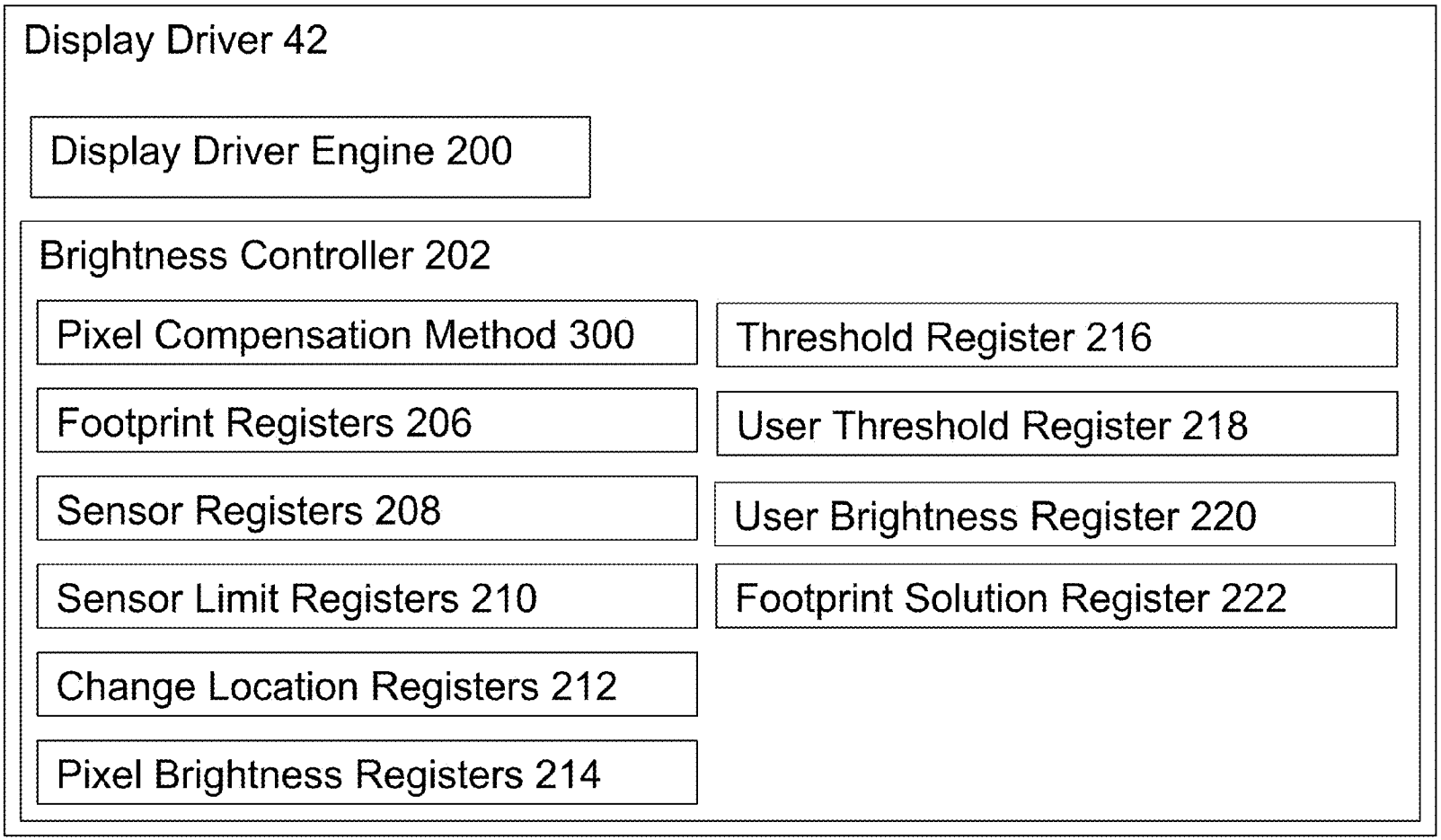
FIG. 2 is a component diagram of the preferred embodiment.

Referring to FIG. 2, display driver 42 of the preferred embodiment comprises: a display driver engine 200 and a brightness controller 202.

Display driver engine 200 is for driving the display with graphics information as provided by an external source.

Brightness controller 202 is for controlling the brightness of the pixels of the display according to the preferred embodiment of the invention. Brightness controller comprises:

pixel compensation method 300; footprint registers 206; sensor registers 208; sensor limit registers 210; change location registers 212; pixel brightness registers 214; threshold register 216; user threshold register 218; user brightness register 220; and footprint solution register 222. The preferred embodiment changes only the brightness of the pixels, however, other embodiments reduce glare by changing other properties of the pixel illumination. Such properties include: the relative brightness or contrast of pixels; the brightness of individual tones; and the saturation levels of colors.

Pixel compensation method 300 is for determining pixels for compensation according to estimations of glare falling on the sensors and for compensating the brightness of the determined pixels according to the glare estimations. This method is described more fully below with respect to FIGS. 3 and 4.

Footprint registers 206 are for storing one or more footprints. A footprint is the area on display 24 where glare is estimated to fall by method 300.

Sensor registers 208 are for recording the values of the sensors 26. These values are used by method 300 in estimating where glare is falling.

Sensor limit registers 210 are for recording maximum and minimum values held by the sensors as calculated by method 300. The maximum and minimum sensor values are used to determine when a sensor value change is significant and indicates a sensor with glare adjacent a sensor without glare.

Change location registers 212 are for recording start and finish locations of sensors where there is glare as calculated by method 300. A different embodiment might record locations where there is no glare.

Pixel brightness registers 214 stores the value of brightness used to control each pixel. These registers are changed by method 300 when a pixel is required to change its brightness.

Threshold register 216 is for storing a threshold value 216' that represents when sensor value is large enough to be considered a change.

User threshold register 218 is for storing a user adjustable threshold value 218' that is used to influence the threshold value 216'. Adjusting the user adjustable threshold value 218' has the effect of changing the sensitivity of detecting the glare and subsequent compensation.

User brightness register 220 is for storing a user adjustable brightness value 220' that is used by method 300 to determine how much compensation is applied. On adjusting the user brightness value 220', a user will see the brightness of the footprint pixels change and the user optimize the experience by finding a preferred user brightness value 220'.

Footprint solution register 222 holds one of several allowable footprint solution references 222' representing footprint solutions that satisfy a pattern of illuminated sensors. A user can scan through the allowable footprint solution references (for example the numbers 1 to 3) and the respective footprint solution is displayed on the display. The user settles on a preferred footprint solution 222" (for example solution no. 2) and the footprint solution register 222 stores the settled footprint solution reference 222".

Figure 3:
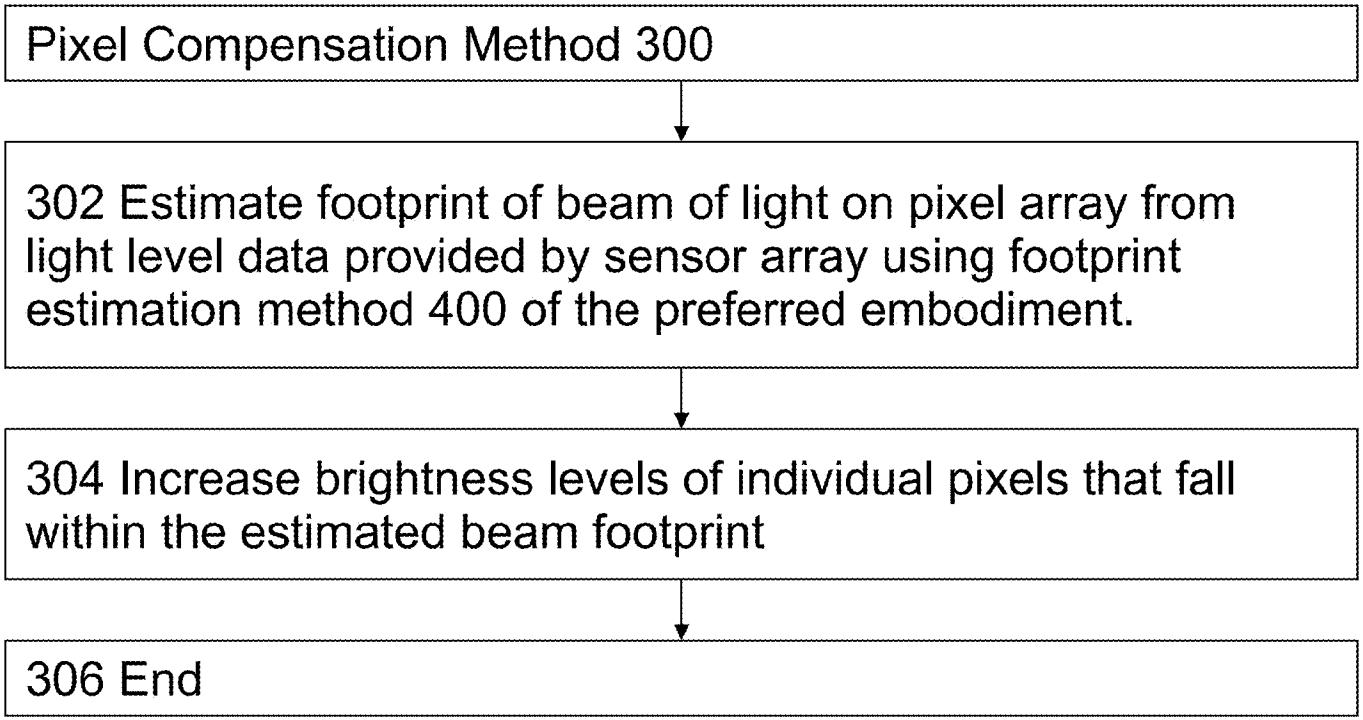
FIG. 3 is a method diagram of a pixel compensation method of the preferred embodiment.

Referring to FIG. 3, pixel compensation method 300 of the preferred embodiment comprises logical process steps 302 to 306.

Step 302 is for estimating a footprint of beam of light on pixel array from light level data provided by sensor array. In the preferred embodiment, step 302 calls preferred footprint estimation method 400. On return from call footprint estimation method 400 control passes to step 304. The estimation process understands the number, arrangement and location of sensors. The preferred embodiment and preferred footprint estimation method 400 uses a single circuit of sensors but other embodiments use two or more circuits of sensors.

Step 304 is for increasing the brightness levels of individual pixels that fall within the estimated beam footprint. Method 300 adjusts one factor and a user can adjust another factor so the overall brightness of the footprint is changed by both the method and the user.

Step 306 is the end of pixel compensation method 300.

Figure 4:
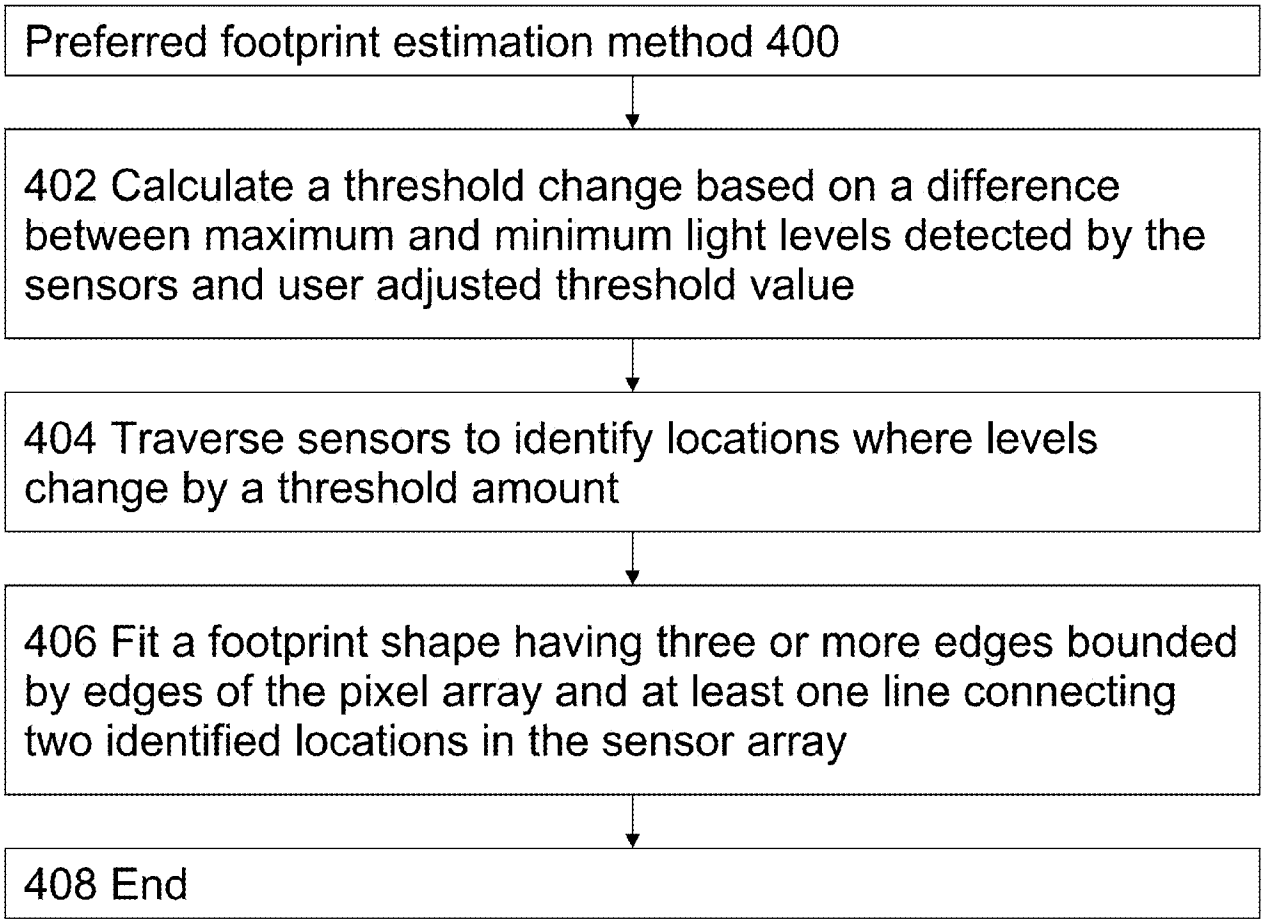
FIG. 4 is a method diagram of a footprint estimation method of the preferred embodiment.

Referring to FIG. 4, preferred footprint estimation method 400 of the preferred embodiment comprises logical steps 402 to 408.

Step 402 is for calculating a threshold change based on a difference between maximum and minimum light levels detected by the sensors and user adjusted threshold value 218'.

Step 404 is for traversing sensors to identify locations where levels change by a threshold value 216'.

Step 406 is for fitting a footprint shape having three or more edges bounded by edges of the pixel array and at least one line connecting two identified locations in the sensor array Step 408 is the end of footprint estimation method 400.

The preferred embodiment of the invention comprises a single circuit of sensors whereby pixel compensation process 300 makes a first approximation that a single shaft of light falls across the display and sensor circuit. Preferred pixel compensation process 300 starts at the top left corner as the default but any point on the circuit can be chosen (see footprint estimation step 404). Each time process 300 hits a change point that represents sensor transition from light to dark (moving clockwise), the point and location are recorded and the change point is checked for a corresponding dark to light change point located at an opposite position on the display (either already located or located on the continued clockwise traversal of the sensor perimeter). The process continues to traverse the circuit of sensors, connecting corresponding change points until the process locates a change point that has already been connected to another change point.

In the preferred embodiment, all pixels in the estimated footprint area receive the same treatment as each other but in another embodiment pixels may get a different treatment. Similarly pixels outside the footprint area are treated equally in the preferred embodiment.

In the preferred embodiment, the threshold for considering a sensor to be light and dark is based on the threshold value 216' and a user configurable threshold value 218'. Therefore the overall ambient lighting in the room is taken into consideration. Change points are only recorded when there is a sufficient difference between the light in the glare and the light level outside the glare. It is this sufficient difference that is user configurable.

Since the sensors along the sensor circuit from light readings are not continuous, the calculated footprint shape is an approximation of the actual glare. As such, the pixels at an edge of a footprint are subjected to smoothing such as a gradient change across the divide, not a step change. The higher the density of light sensors in the circuit, the smaller the area over which this gradient change is applied.

Figure 5:
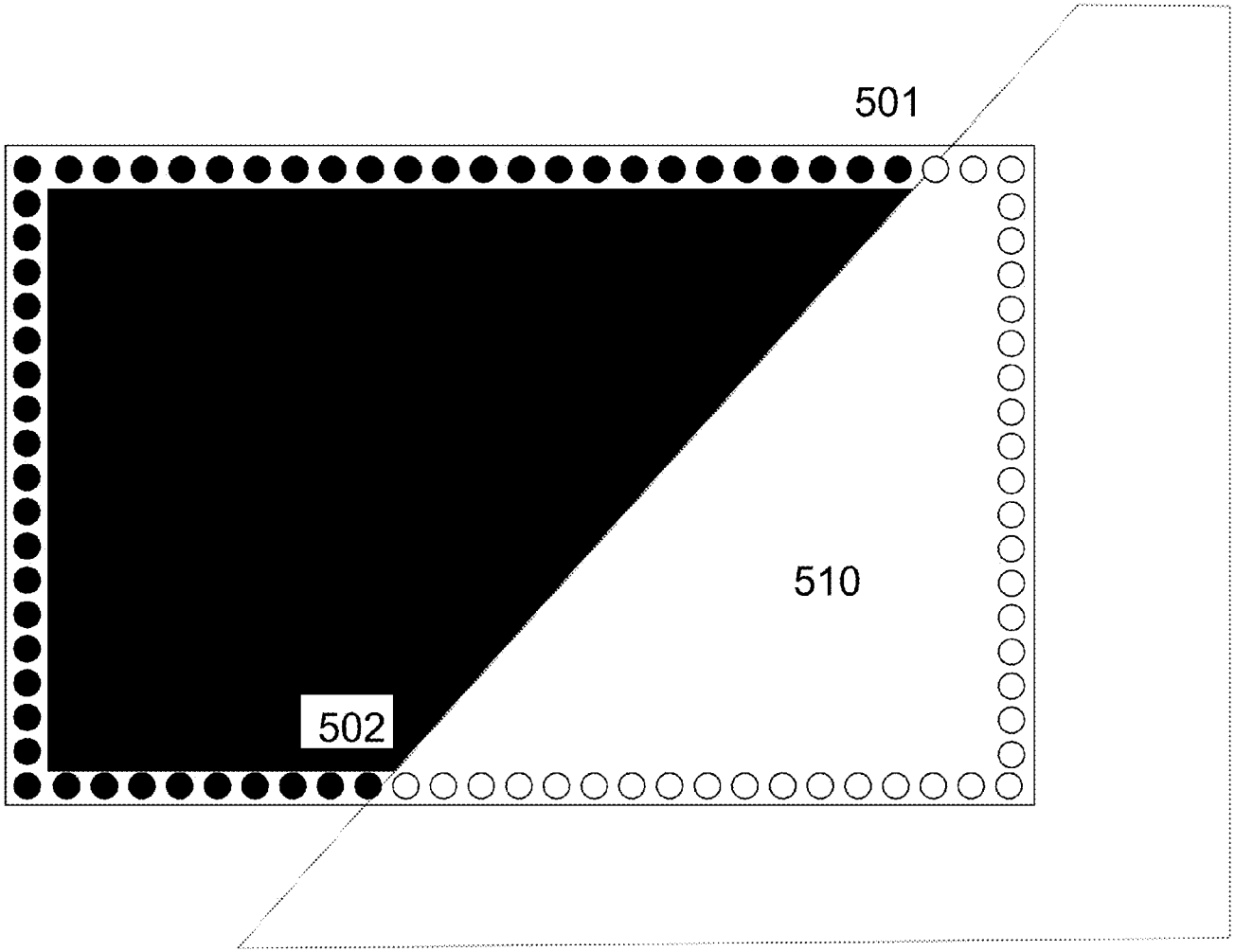
FIG. 5 is an example glare footprint with a single glare edge on a display.

Referring to FIG. 5, an example of a glare footprint with a single edge is described. Brightness controller 202 traverses clockwise the sensors from the top left corner of the circuit and locates and records change point 501 as a first dark to light transition (going in the clockwise direction). Brightness controller 202 continues to traverse the circuit of sensors and next locates and records bottom most change point 502 as a light to dark transition. Brightness controller 202 assumes that it has passed through a glare and that a line connecting change points 501 and 502 form a single edge of a glare footprint 510 on the right side of the display. Brightness controller 202 then compensates the pixels in footprint 510 to reduce the effect of the glare.

Figure 6:
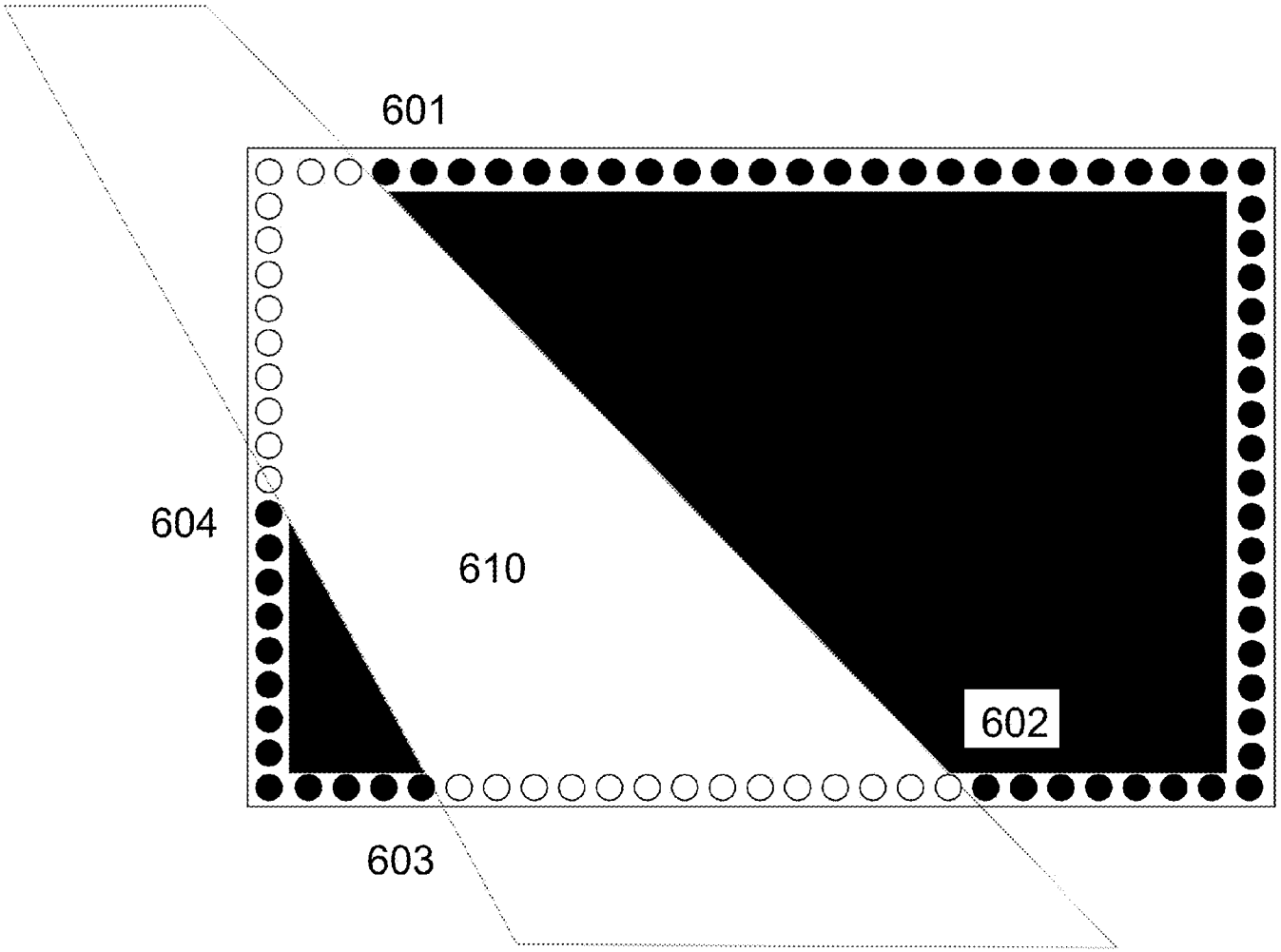
FIGS. 6 and 7 are examples of a glare footprint from a shaft of light.

Referring to FIG. 6, an example of a glare footprint from a shaft of light with two glare edges on a sensor array of the preferred embodiment is described. Brightness controller 202 traverses the sensors from the top left corner to locate and record top most change point 601; change point 601 is a transition from light to dark. Brightness controller 202 traverses sensors clockwise locating bottom right change point 602 with a complementary dark to light transition; brightness controller 202 records change point 602 and connects it to change point 601 for estimating a glare edge. Brightness controller 202 continues to traverse the sensors thereby locating and recording bottom-left change point 603, changing from light to dark. Brightness controller 202 locates and records left side change point 604, changing from dark to light. Brightness controller 202 finds that change point 604 (dark to light) complements the previous change point 603 (light to dark) and a connection is made to form another glare edge. Brightness controller 202 continues to traverse thereby finding the topmost point again whereby it stops and assumes that the located glare edges 601/602 and 603/604 are part of a double edged glare 610.

Figure 7:
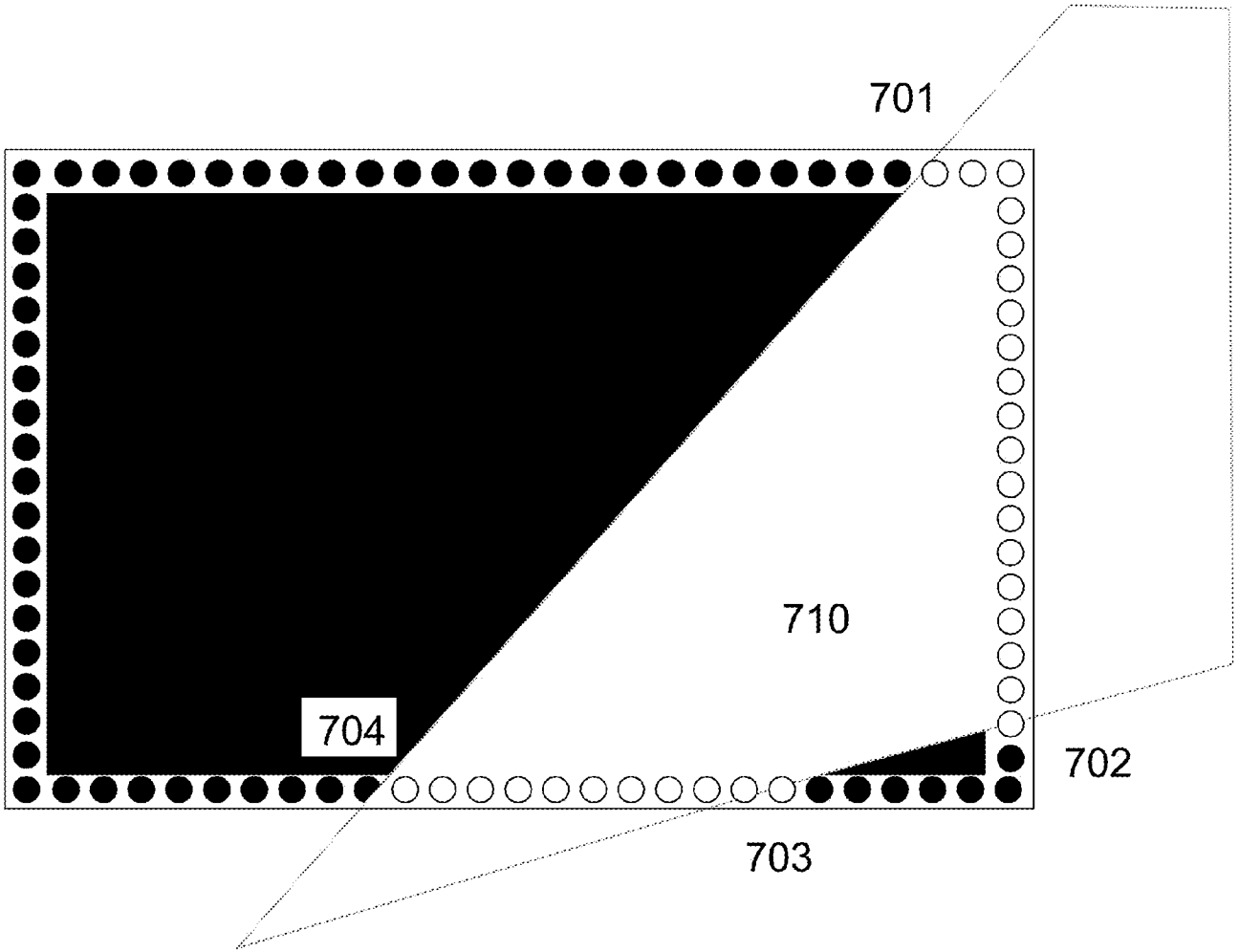

Referring to FIG. 7, another example of a glare footprint with two glare edges on a sensor array of the preferred embodiment is described; this example has opposite transitions to that of FIG. 6. Starting from the top left corner and moving clockwise, brightness controller 202 locates and records dark to light change point 701. Next, brightness controller 202 locates and records right most change point 702 which is a light to dark transition. Since change point 701 is a dark to light and change point 702 is light to dark then brightness controller 202 of the preferred embodiment assumes that these points are inside the glare and not on an edge of the glare. No connections are made. Next, brightness controller 202 locates and records change point 703 as a dark to light change point. Since change point 703 and 702 correspond, brightness controller assumes that a glare edge 702/703 exists. Next, brightness controller 202 locates and records change point 704 as a light to dark change point. When no further change points are located then brightness controller 202 connects change points 704 and 701 and assumes that glare edges 701/704 and 702/703 are part of a double edged glare shaft 710.

Figure 8:
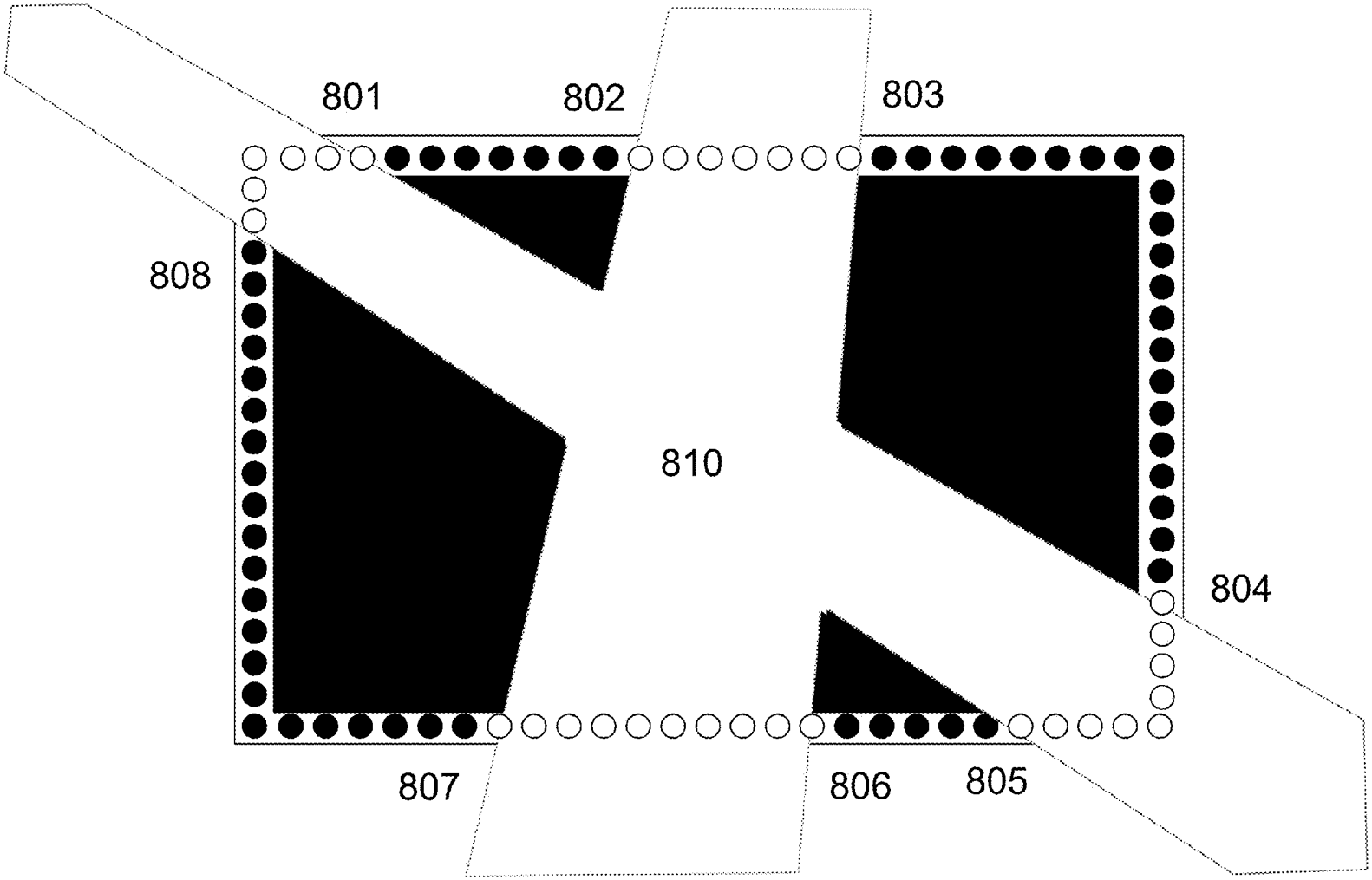
FIGS. 8 to 10 are examples of three different footprint solutions for the same sensor illumination.
Figure 9:
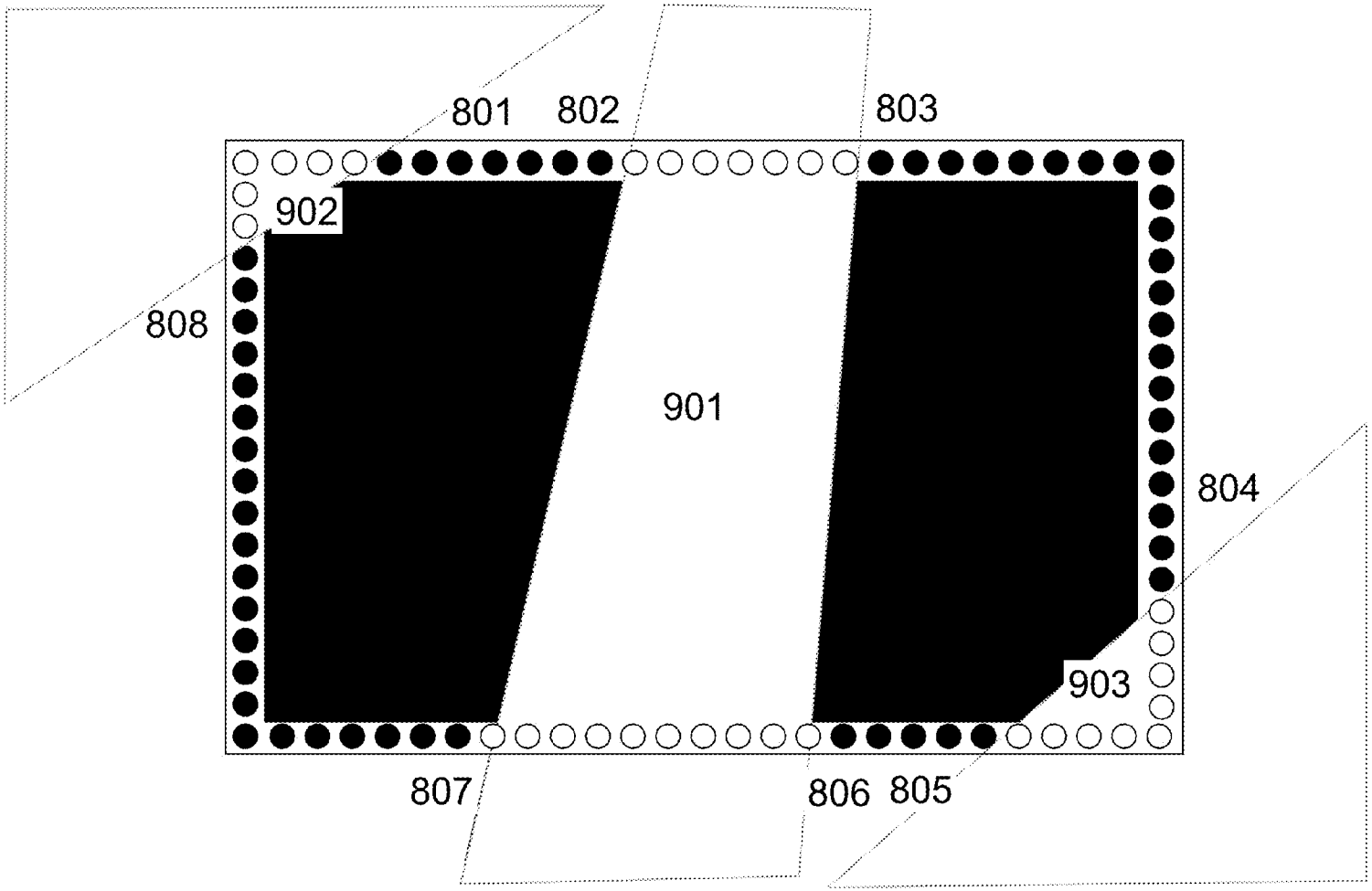
Figure 10:
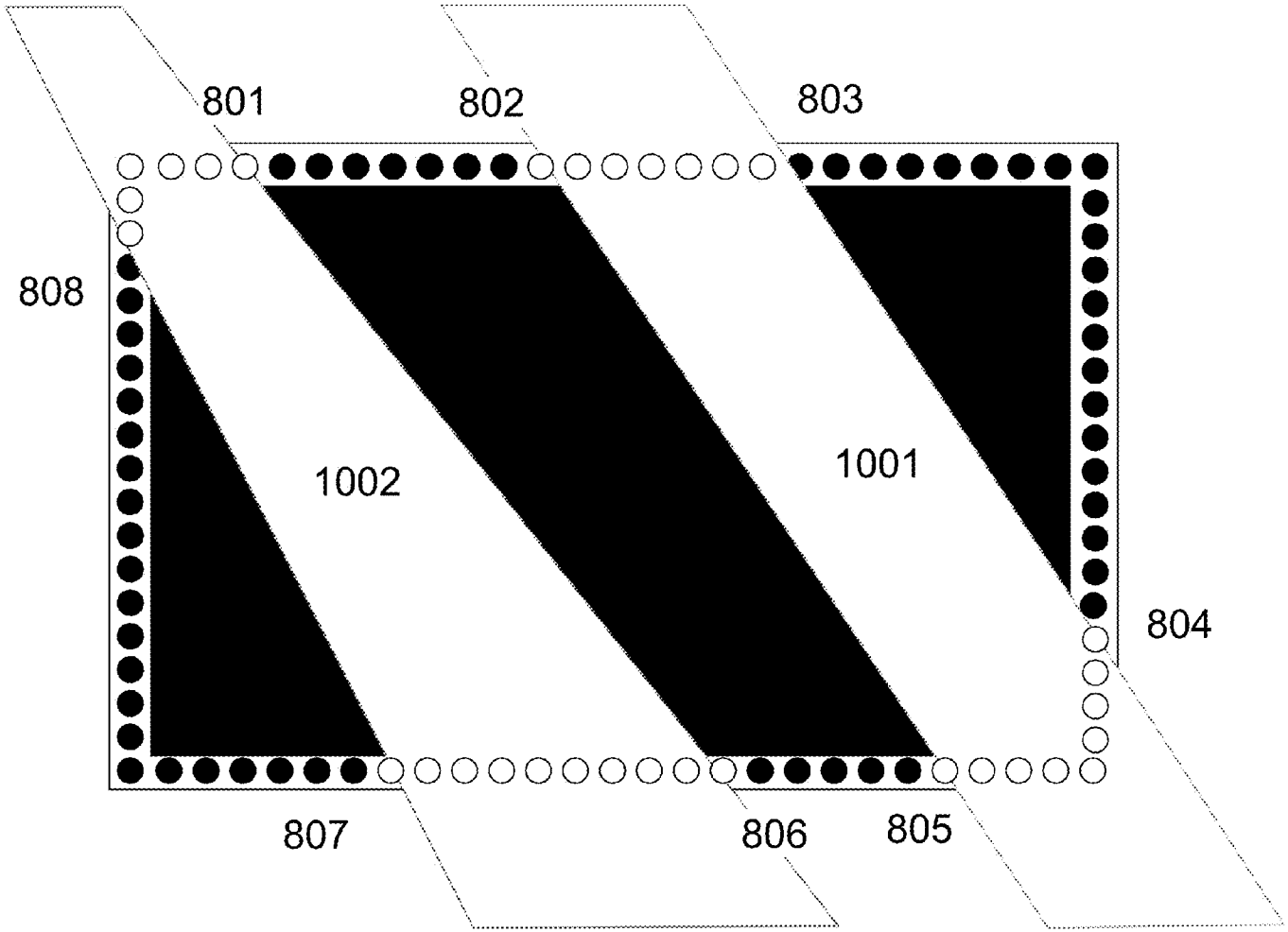

FIGS. 8, 9 and 10 are examples of different estimated footprint solutions from the same example illuminated sensors. In each FIGS. 8, 9 and 10, brightness controller 202 starts traversing the sensors from the top left in the clockwise direction and locates eight change points: 801-808. Brightness controller 202 has to determine whether groups of illuminated sensors are in the same glare or a difference glares, in the preferred embodiment with a single layer of sensors brightness controller 202 will identify more that one solution. In this case, the user chooses the footprint solution that works best for the user by scanning through the allowed footprint solution references 222' in footprint solution register 222 and settling on a preferred footprint reference 222".

Referring to FIG. 8, brightness controller 202 finds a first solution: whereby illuminated sensors between 801 and 808 are in the same glare as illuminated sensors 804 and 805; and whereby illuminated sensors between 802 and 803 are in the same glare as illuminated sensors 806 and 807. Hence the first solution is a single footprint 810 of two joined glares.

Referring to FIG. 9, brightness controller 202 finds a second solution: whereby illuminated sensors between 802 and 803 are in a first glare as illuminated sensors 806 and 807; whereby illuminated sensors between 804 and 805 are in a second glare; and whereby illuminated sensors between 808 and 801 are in a third glare. Hence the second solution comprises three separate glares and footprints: footprint 901; footprint 902 and footprint 903.

Referring to FIG. 10, brightness controller 202 finds a third solution: whereby illuminated sensors between 802 and 803 are in the same glare as illuminated sensors 804 and 805; and whereby illuminated sensors between 806 and 807 are in the same glare as illuminated sensors between 808 and 801. Hence the third solution comprises: footprint 1001 and footprint 1002 and two separate glares.

In another embodiment, a camera mounted opposite the screen provides an image that can compare the footprint solutions in order to verify which solution accurately represents the real glare pattern of light and darks. From a single line of sensors, all of the possible footprint solutions are compared to the data from the camera to assess which is the best fit.

In cases where there are multiple shafts of light falling across the display, the preferred embodiment identifying change points around a single circuit of sensors does not allow for calculation of a unique footprint solution. To address this, a vector rather than a point must be identified and the sensor array of a second embodiment comprises sensors laid out in two staggered circuits. When a change point is identified on the inner circuit, the outer circuit of sensors is checked to pick out which direction the shaft is crossing the circuits. The direction determines whether to traverse clockwise or anticlockwise to locate the next change point.

Figure 11:
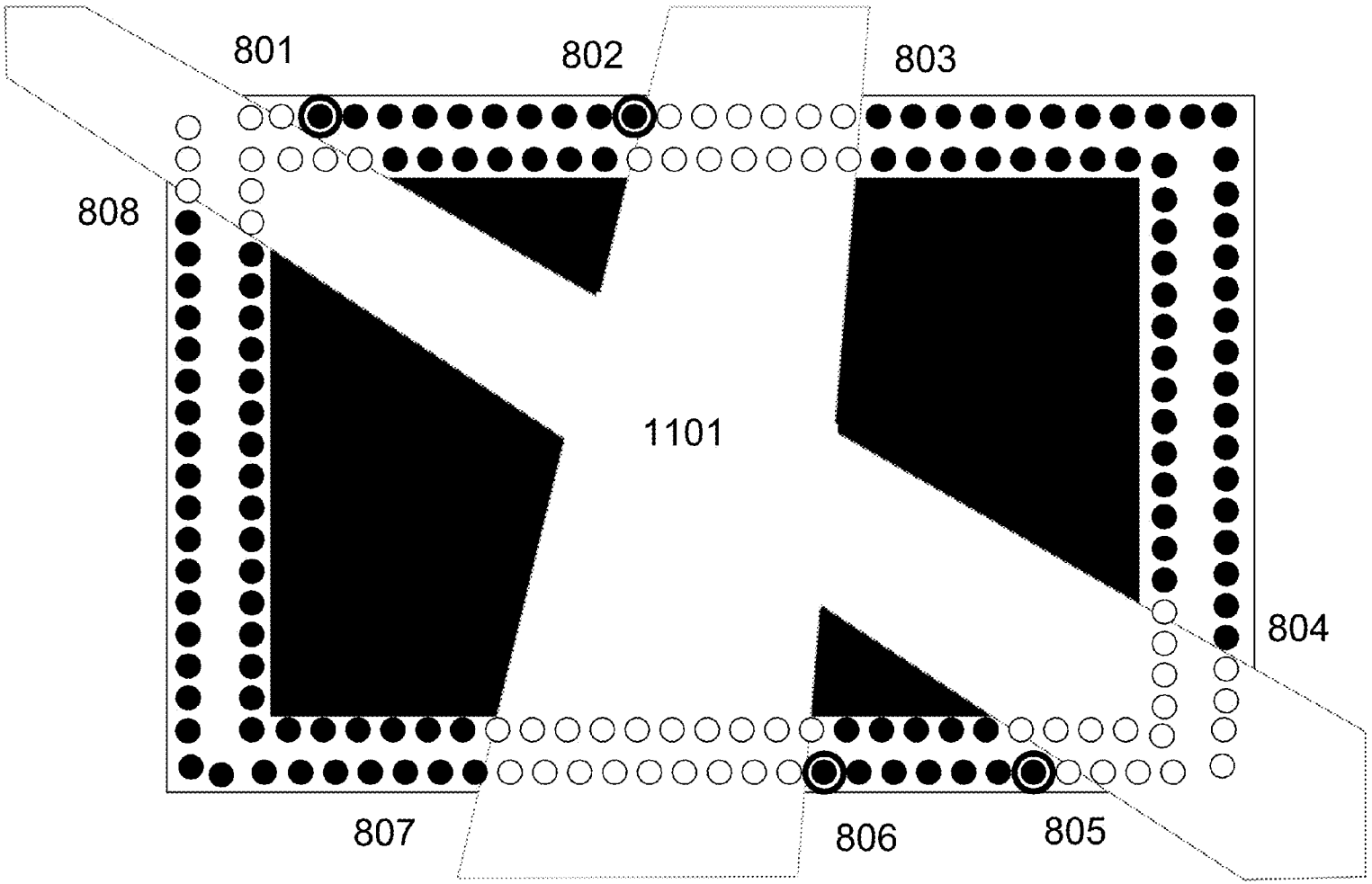
FIG. 11 is an example of a solution for the sensor illumination of FIGS. 8 to 10 as determined by a double circuit sensor array.

Referring to FIG. 11, an example of a glare footprint 1101 in a double sensor circuit embodiment is described. A second rectangular circuit of sensors is concentric with the first circuit of sensors. The second rectangular circuit of sensors allows potential solutions to be tested against the illuminated sensors on the second circuit thus eliminating some solutions where the more than one solution is found using the first circuit. In FIG. 11, four sensors with concentric rings are highlighted examples of sensors that would be expected to be illuminated if the footprint solution 1101 was not FIG. 8 but FIG. 9 or FIG. 10. Therefore a double sensor circuit embodiment allows for greater precision when choosing footprint solutions but comes at a cost of at least twice the numbers of sensors. Nevertheless, a solution according to a double sensor circuit embodiment provides an economical solution in certain situations.

Figure 12:
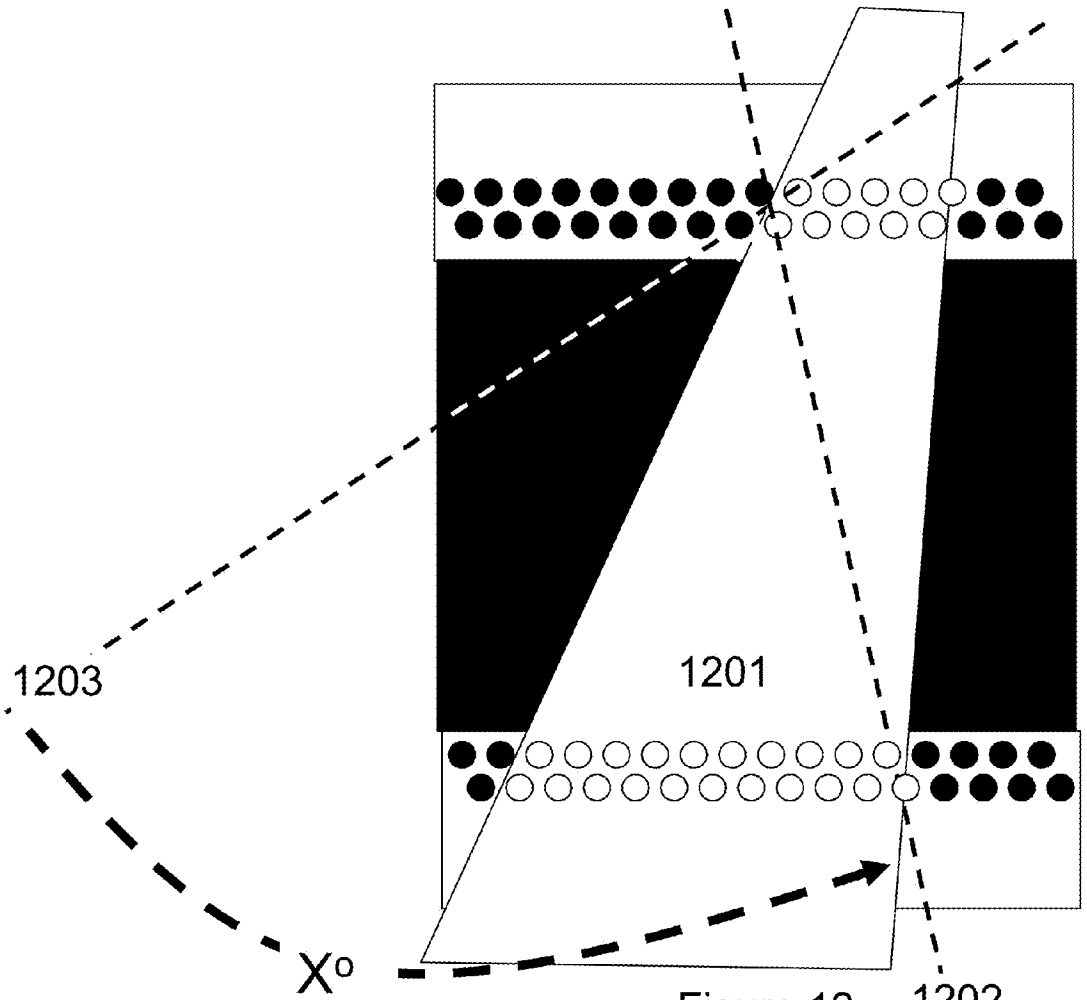
FIG. 12 shows an example of a glare footprint on a double circuit sensor array with a narrow spacing.
Figure 13:
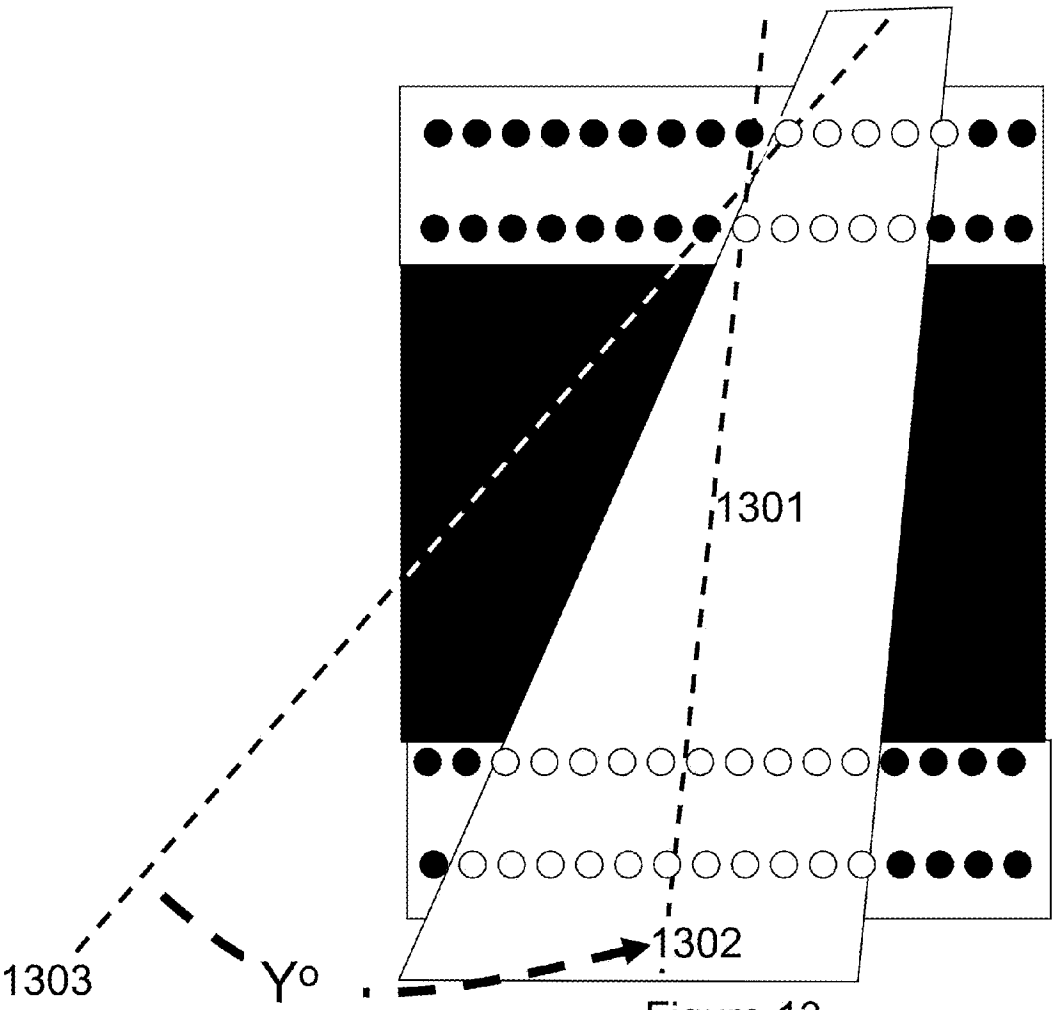
FIG. 13 shows the example of FIG. 12 on a double circuit sensor array with a wide spacing.

Referring to FIG. 12 and FIG. 13, an example of a glare footprint on a double circuit sensor array with respective narrow and wide spacing is described to show an enhancement and the effect of a narrow and wide spacing for sensor circuits. An enhancement for double sensor circuit embodiments uses a vector to calculate an arc in which to search for the corresponding edge-point to connect this one up to. For every averaged footprint edge there are margins of error either side illustrated by tangents 1202 and 1203 between individual sensors in FIG. 12 and by tangents 1302 and 1303 in FIG. 13. The tangents define arc X in FIG. 12 and arc Y in FIG. 13 in which to search for a corresponding change point on the opposite side of the sensor bezel. Greater spacing between the inner and outer circuits of sensors of FIG. 13 compared to FIG. 12 reduces the size of the arc Y when compared to arc X. Reducing the spacing of the sensors in the same circuit has a similar effect. A side-benefit of using tangents to calculate an arc is that failure of a glare to reach the opposite side of the display can be more readily detected. If an edge point is not found within the prescribed arc then an embodiment could halt execution and decide that the lighting conditions are not suitable for brightness correction.

Figure 14:
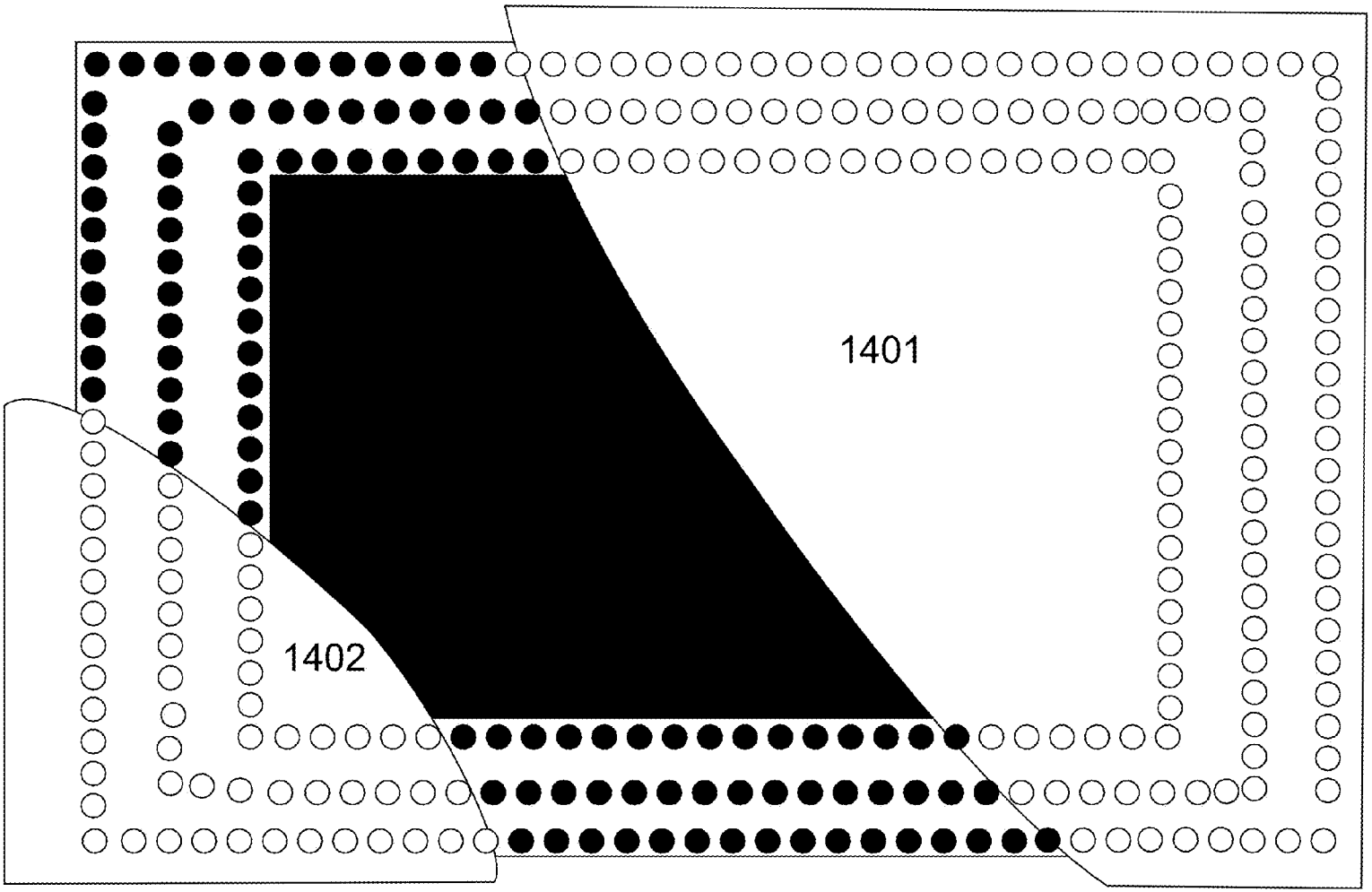
FIG. 14 shows an example of two curved glare footprints on a triple circuit sensor array.

FIG. 14 shows an example of elliptical footprints detected on a triple circuit sensor array. The single and double circuit embodiments address the case of shafts of light whereas a triple sensor circuit embodiment can cover point sources of light that throw elliptical glares onto the screen (for example a desk lamp). The third circuit of sensors allows a modified brightness controller 202 to calculate curvature of one or more glares (for example footprint 1401 and 1402).

In a double circuit embodiment, two circuits and two respective change point locations on a screen allow a linear extrapolation of a glare edge; such a glare edge may or my not be confirmed by a corresponding change point locations on the corresponding screen edge. In a triple circuit embodiment, three known change point locations on a screen allow a quadratic (or curved) extrapolation of a glare edge; such a glare edge may or may not be confirmed by corresponding change point locations on the corresponding screen edge. In a further two circuit embodiment, a curved glare edge could be approximated with using two circuits with two pairs of change points, a triple circuit embodiment provides a more accurate approximation.

Figure 15:
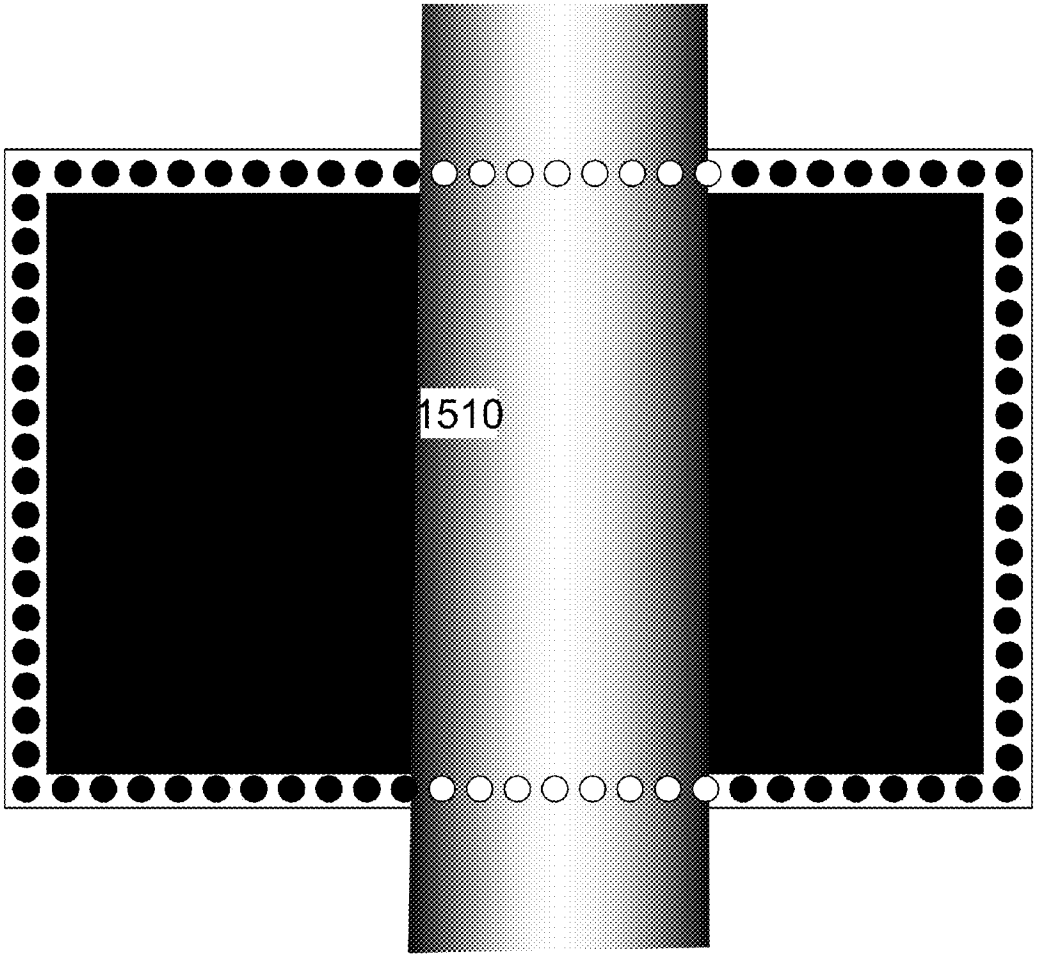
FIG. 15 shows an example of a graduated glare footprint.

Referring to FIG. 15, an example of a graduated footprint embodiment is described. The preferred embodiment outlined above detects discrete change point where transitions are from a definite light to a definite dark (or vice versa). A graduated footprint embodiment also considers the data from the sensors in between these edge points. A modified brightness controller considers brightness levels of the sensors and records where the light is at its brightest and dimmest within a footprint such as 1510. A graduated brightness pattern is interpolated between the change points. In this way, a central band of footprint 1510 can be more intensely lit.

Figure 16:
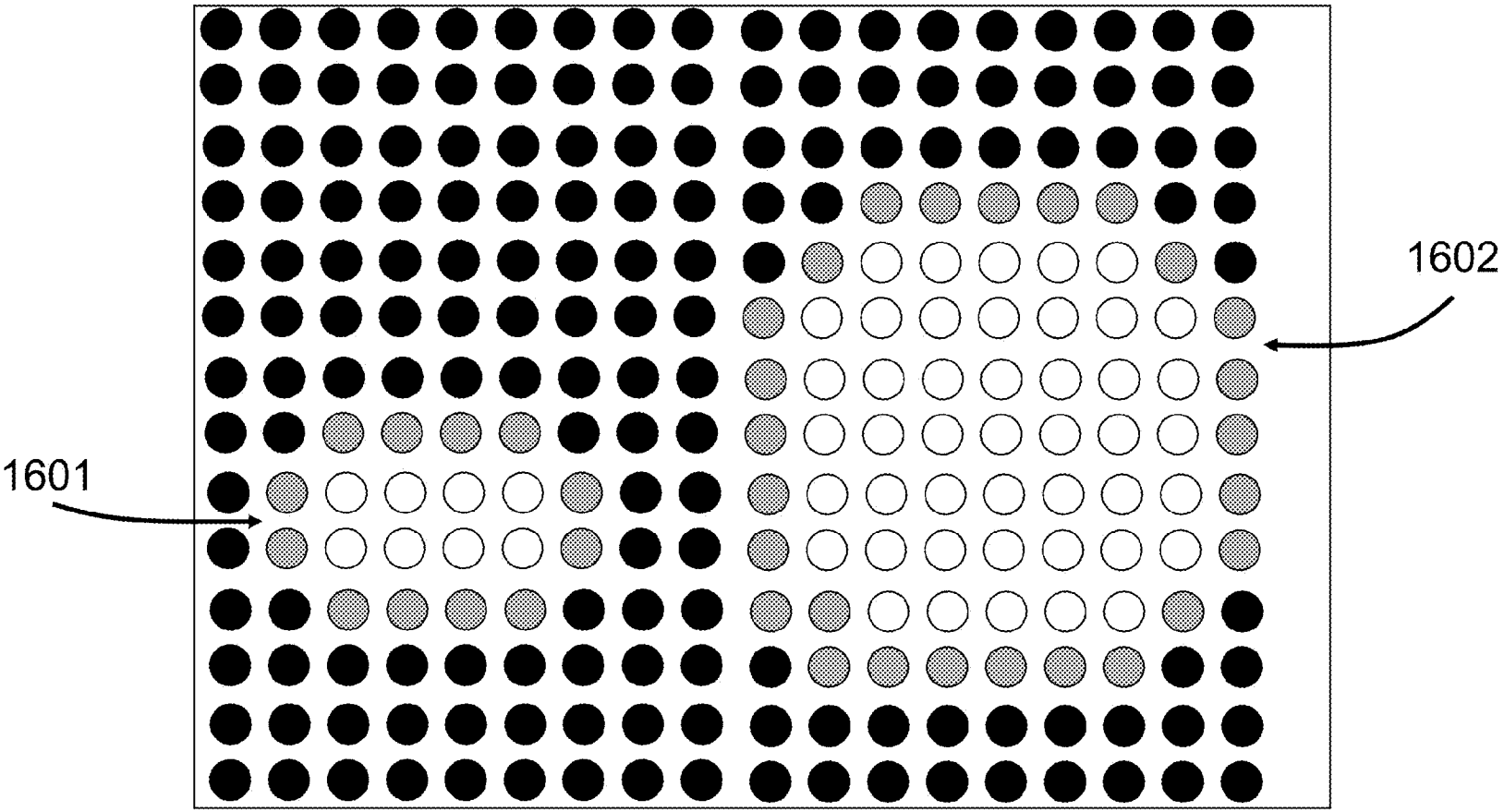
FIG. 16 shows a sensor array underlying the display for detecting example glares.
Figure 17:
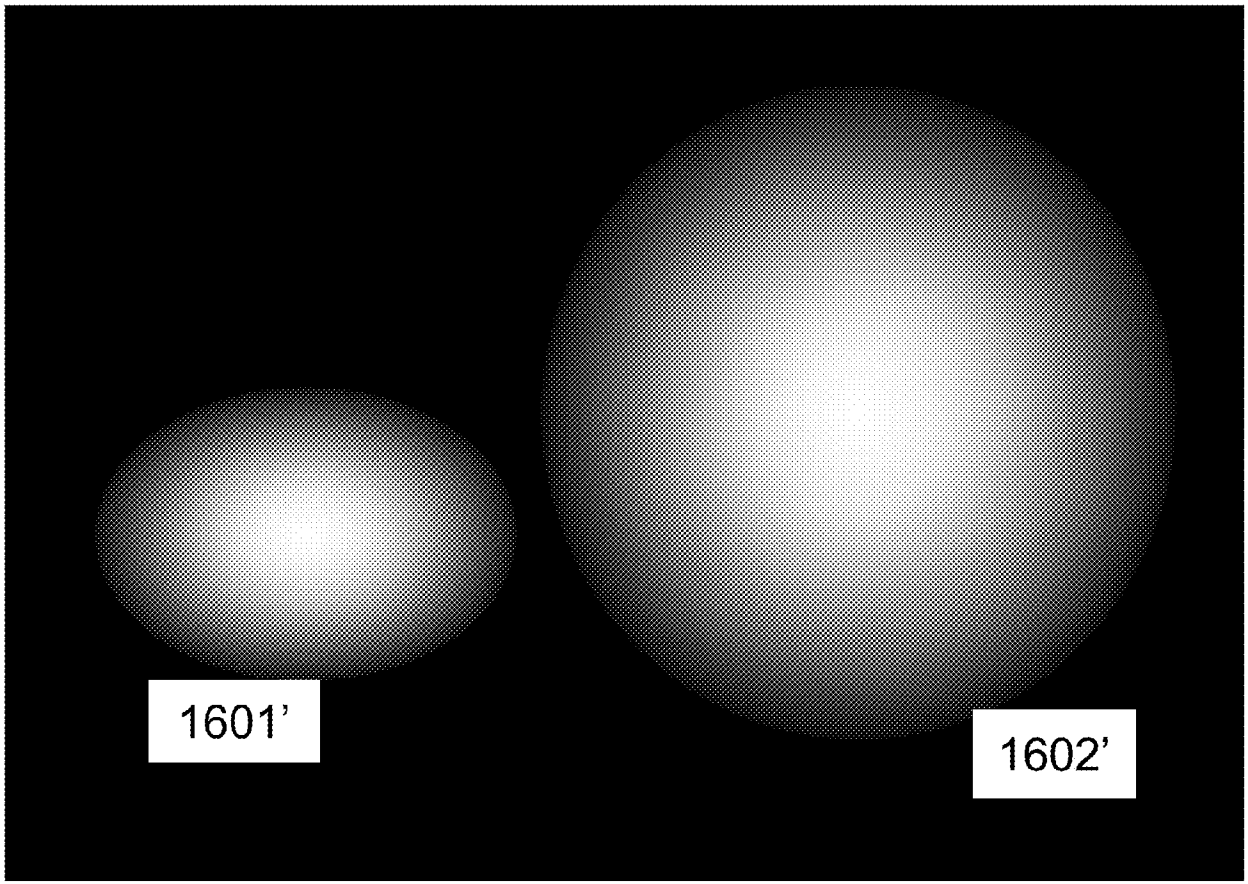
FIG. 17 shows two example elliptical graduated glares of FIG. 16 centered on a display and not touching a display edge.

Referring to FIGS. 16 and 17, an example of a full sensor embodiment is described. FIG. 16 shows a full sensor embodiment array of sensors lying behind the display and detecting glare coming through the display. In this embodiment, no extrapolation of the glare shapes need to be performed and a modified brightness controller detects the shapes and glare brightness directly and adjusts the overlaying pixels accordingly. Such a full sensor embodiment detects glare that falls in the middle of the display and does not reach an edge, for example sensor illumination 1601 and 1602 in FIG. 16 and glare patterns 1601' and 1602' in FIG. 17.

Further Embodiments

The embodiments are of particular use for critical displays that cannot be easily repositioned.

One example would be displays in vehicles (bicycles, cars, motorcycles, trains, ships, boats and aircraft) such as a digital speedometer output, satellite navigation, or rear-view displays. Visual disruption of such displays by light beams could lead to safety risks for the driver. Another example is in shops for checkout screens that are fixed in place and not easily movable.

It will be clear to one of ordinary skill in the art that all or part of the method of the preferred embodiment may suitably and usefully be embodied in additional logic apparatus or additional logic apparatuses, comprising logic elements arranged to perform the steps of the method and that such logic elements may comprise additional hardware components, firmware components or a combination thereof.

It will be equally clear to one of skill in the art that some or all of the functional components of the preferred embodiment may suitably be embodied in alternative logic apparatus or apparatuses comprising logic elements to perform equivalent functionality using equivalent method steps, and that such logic elements may comprise components such as logic gates in, for example a programmable logic array or application-specific integrated circuit. Such logic elements may further be embodied in enabling elements for temporarily or permanently establishing logic structures in such an array or circuit using, for example, a virtual hardware descriptor language, which may be stored and transmitted using fixed or transmittable carrier media.

It will be appreciated that the method and arrangement described above may also suitably be carried out fully or partially in software running on one or more processors (not shown in the figures), and that the software may be provided in the form of one or more computer program elements carried on any suitable data-carrier (also not shown in the figures) such as a magnetic or optical disk or the like. Channels for the transmission of data may likewise comprise storage media of all descriptions as well as signal-carrying media, such as wired or wireless signal-carrying media.

The present invention may further suitably be embodied as a computer program product for use with a computer system. Such an implementation may comprise a series of computer-readable instructions either fixed on a tangible medium, such as a computer readable medium, for example, diskette, CD-ROM, ROM, or hard disk, or transmittable to a computer system, using a modem or other interface device, over either a tangible medium, including but not limited to optical or analogue communications lines, or intangibly using wireless techniques, including but not limited to microwave, infra-red or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infra-red, or microwave. It is contemplated that such a computer program product may be distributed as a removable medium with accompanying printed or electronic documentation, for example, shrink-wrapped software, pre-loaded with a computer system, for example, on a system ROM or fixed disk, or distributed from a server or electronic bulletin board over a network, for example, the Internet or World Wide Web.

In an alternative, the preferred embodiment of the present invention may be realized in the form of a computer implemented method of deploying a service comprising steps of deploying computer program code operable to, when deployed into a computer infrastructure and executed thereon, cause the computer system to perform all the steps of the method.

In a further alternative, the preferred embodiment of the present invention may be realized in the form of a data carrier having functional data thereon, said functional data comprising functional computer data structures to, when loaded into a computer system and operated upon thereby, enable said computer system to perform all the steps of the method.

It will be clear to one skilled in the art that many improvements and modifications can be made to the foregoing exemplary embodiment without departing from the scope of the present invention.

The invention claimed is:

1. A display comprising:

an array of pixels having individually adjustable brightness levels;

an array of light sensors fixed relative to the pixel array, wherein the array of light sensors extends around the display; and a brightness controller configured to estimate a glare footprint on the pixel array from light level data provided by the sensor array by connecting a light-to-dark change point for one of the array of light sensors located at one side of the display with a complementary dark-to-light change point for another of the array of light sensors located at another side of the display and to adjust the relative brightness levels of pixels that fall in the estimated glare footprint, wherein the array of light sensors in its entirety extends around the display in its entirety.

2. The display according to claim 1 wherein the array of light sensors extends around the display in at least two circuit sensor arrays, where a second circuit sensor array of the at least two circuit sensor arrays is concentric and staggered with respect to a first circuit sensor array of the at least two circuit sensor arrays, and wherein the light-to-dark change point is part of the first circuit sensor array and the brightness controller is configured to determine which direction the glare footprint is crossing the at least two circuit sensor arrays using the second circuit sensor array.

3. The display according to claim 1 wherein the array of light sensors is at least one of: a single circuit of light sensors one sensor thick; two circuits of light sensors two sensors thick; three circuits of light sensors three sensors thick; and more than three circuits of light sensors.

4. The display according to claim 1 wherein the brightness controller is configured to linearly traverse the array of light sensors to identify locations where light level changes by a threshold amount and fits a footprint shape with three or more edges bounded by edges of the pixel array and at least one line connecting the light-to-dark change point and the complementary dark-to-light change point, wherein the threshold of light level change depends on a difference between maximum and minimum light levels detected by the sensors and is user configurable.

5. The display according to claim 1 wherein the increase in brightness level of a pixel is based on an estimated amount of light falling at the pixel location.

6. The display according to claim 1 wherein the increase in brightness levels of a pixel is user adjustable.

7. The display according to claim 1 wherein the amount of light falling is estimated as uniform over a single footprint and is different for two or more footprints over the array and is higher for overlapping footprint areas.

8. The display according to claim 1, wherein the glare footprint comprises a plurality of distinct estimated glare footprints, where a given one of the plurality of distinct estimated glare footprints is presented on the display and is user selectable using the display.

9. A display comprising:

an array of pixels having individually adjustable brightness levels;

an array of light sensors fixed relative to the pixel array; and a display controller comprising a processing unit, a memory, an input/output (I/O) interface configured to communicate with an external device that enables a user to interact with the display controller, and a brightness controller configured to estimate a glare footprint on the pixel array from light level data provided by the sensor array by connecting a light-to-dark change point for one of the array of light sensors located at one side of the display with a complementary dark-to-light change point for another of the array of light sensors located at another side of the display and to adjust the relative brightness levels of pixels that fall in the estimated glare footprint, wherein the display having pixels with individually adjustable brightness levels is an active matrix organic light emitting diode (AMOLED) display whereby pixels in the "light" areas are configured to have their brightness and contrast raised and pixels in the "dark" areas are configured to have their brightness lowered, wherein the array of light sensors in its entirety extends around the display in its entirety.

10. The display according to claim 9, wherein the brightness controller comprises sensor limit registers that are configured to record maximum and minimum sensor values for each sensor of the array of light sensors and used to determine when a sensor value change indicates a glare adjustment is needed for a given pixel of the array of pixels.

11. The method according to claim 9, further comprising:

calculating a threshold change based on a difference between maximum and minimum light levels detected by the array of sensors and a user adjustable threshold value.

12. A method for controlling brightness of a display, said display comprising an array of pixels having individually adjustable brightness levels and an array of light sensors fixed relative to the pixel array and extending around the display in its entirety, said method comprising: estimating a glare footprint on the pixel array from light level data provided by the sensor array by connecting a light-to-dark change point for one of the array of light sensors located at one side of the display with a complementary dark-to-light change point for another of the array of light sensors located at another side of the display; and adjusting the relative brightness levels of pixels that fall in the estimated glare footprint.

13. The method according to claim 12 wherein the array of light sensors extends around the display in at least two circuit sensor arrays, where a second circuit sensor array of the at least two circuit sensor arrays is concentric and staggered with respect to a first circuit sensor array of the at least two circuit sensor arrays, and wherein the light-to-dark change point is part of the first circuit sensor array and the brightness controller is configured to determine which direction the glare footprint is crossing the at least two circuit sensor arrays using the second circuit sensor array.

14. The method according to claim 12 wherein the array of light sensors is at least one of: a single circuit of light sensors one sensor thick; two circuits of light sensors two sensors thick; three circuits of light sensors three sensors thick; and more than three circuits of light sensors.

15. The method according to claim 12 further comprising linearly traversing the array of light sensors to identify locations where light level changes by a threshold amount and fits a footprint shape with three or more edges bounded by edges of the pixel array and at least one line connecting the light-to-dark change point and the complementary dark-to light change point, wherein the threshold of light level change depends on a difference between maximum and minimum light levels detected by the sensors and is user configurable.

16. The method according to claim 12 wherein the increase in brightness level of a pixel is based on an estimated amount of light falling at the pixel location.

17. The method according to claim 12 wherein the increase in brightness levels of a pixel is user adjustable.

18. An article of manufacture comprising a computer program stored on a non-transitory computer readable medium and loadable into the internal memory of a data processing system, comprising software code portions, when said computer program is run on the data processing system, for performing the method of claim 12.

19. The method according to claim 12, wherein the glare footprint comprises a plurality of distinct estimated glare footprints, where a given one of the plurality of distinct estimated glare footprints is presented on the display and is user selectable using the display.

20. The method according to claim 12, further comprising:

recording maximum and minimum sensor values for each sensor of the array of light sensors; and using the recorded maximum and minimum sensor values to determine when a sensor value change indicates a glare adjustment is needed for a given pixel of the array of pixels.

21. A computer program product for controlling brightness of a display, said computer program product comprising a non-transitory computer readable recording medium having computer readable code stored thereon for performing the method of claim 12.

* * * * *